US009117381B1

(12) United States Patent
Shaw, IV et al.

(10) Patent No.: US 9,117,381 B1
(45) Date of Patent: Aug. 25, 2015

(54) MOUNTABLE SIGN HOLDING APPARATUS

(71) Applicants: Henry B. Shaw, IV, Inkster, MI (US); Brenda Carr, Inkster, MI (US)

(72) Inventors: Henry B. Shaw, IV, Inkster, MI (US); Brenda Carr, Inkster, MI (US)

( * ) Notice: Subject to any disclaimer, the term of this patent is extended or adjusted under 35 U.S.C. 154(b) by 0 days.

(21) Appl. No.: 13/932,798

(22) Filed: Jul. 1, 2013

(51) Int. Cl.
*G09F 21/04* (2006.01)

(52) U.S. Cl.
CPC ..... *G09F 21/04* (2013.01)

(58) Field of Classification Search
USPC ..... 40/590, 591, 593, 647, 652, 658, 660, 40/666, 607.12; 24/509
See application file for complete search history.

(56) References Cited

U.S. PATENT DOCUMENTS

| | | | | | |
|---|---|---|---|---|---|
| 230,647 | A | * | 8/1880 | Myers | 24/132 R |
| 460,754 | A | * | 10/1891 | Moxley | 24/67.7 |
| 4,258,492 | A | | 3/1981 | Williams | |
| 4,590,883 | A | | 5/1986 | Steed et al. | |
| D284,486 | S | | 7/1986 | Gransden | |
| 5,033,528 | A | * | 7/1991 | Volcani | 160/351 |
| 5,056,822 | A | * | 10/1991 | Shim | 281/44 |
| 5,479,735 | A | * | 1/1996 | Martin, Jr. | 40/593 |
| 5,489,121 | A | | 2/1996 | Mohr | |
| 5,881,481 | A | | 3/1999 | Bashaw, Jr. et al. | |
| 6,634,532 | B1 | | 10/2003 | Maguire | |
| 7,356,869 | B2 | * | 4/2008 | Knopow et al. | 15/210.1 |

* cited by examiner

*Primary Examiner* — Joanne Silbermann

(57) ABSTRACT

A mountable sign holding apparatus attaches a sign to a handlebar or a steering wheel of a vehicle to communicate a warning to pedestrians against touching the vehicle. The apparatus includes an elongated tube. A sign is coupled to and extends outwardly from an upper end of the tube. A coupler is attached to a bottom end of the tube and is configured to frictionally engage a steering control of a vehicle and support each of the tube and the sign on the steering control.

17 Claims, 4 Drawing Sheets

MOUNTABLE SIGN HOLDING APPARATUS

BACKGROUND OF THE DISCLOSURE

1. Field of the Disclosure

The disclosure relates to sign holding apparatuses and more particularly pertains to a new sign holding apparatus for attaching a sign to a handlebar or a steering wheel of a vehicle to communicate a warning to pedestrians against touching the vehicle.

2. Summary of the Disclosure

An embodiment of the disclosure meets the needs presented above by generally comprising an elongated tube. A sign is coupled to and extends outwardly from an upper end of the tube. A coupler is attached to a bottom end of the tube and is configured to frictionally engage a steering control of a vehicle and support each of the tube and the sign on the steering control.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
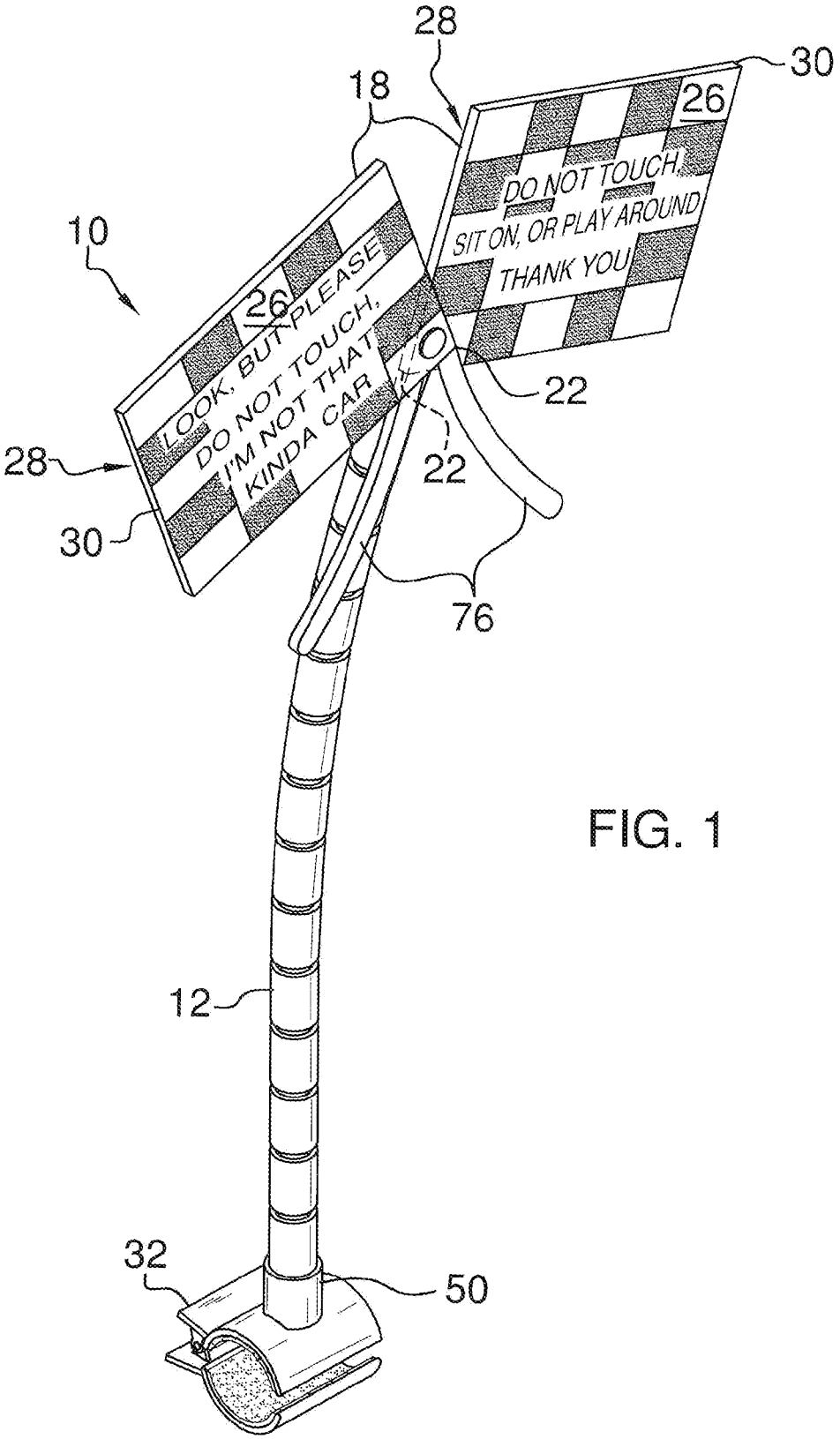
FIG. 1 is a top front side perspective view of a mountable sign holding apparatus according to an embodiment of the disclosure.
Figure 2:
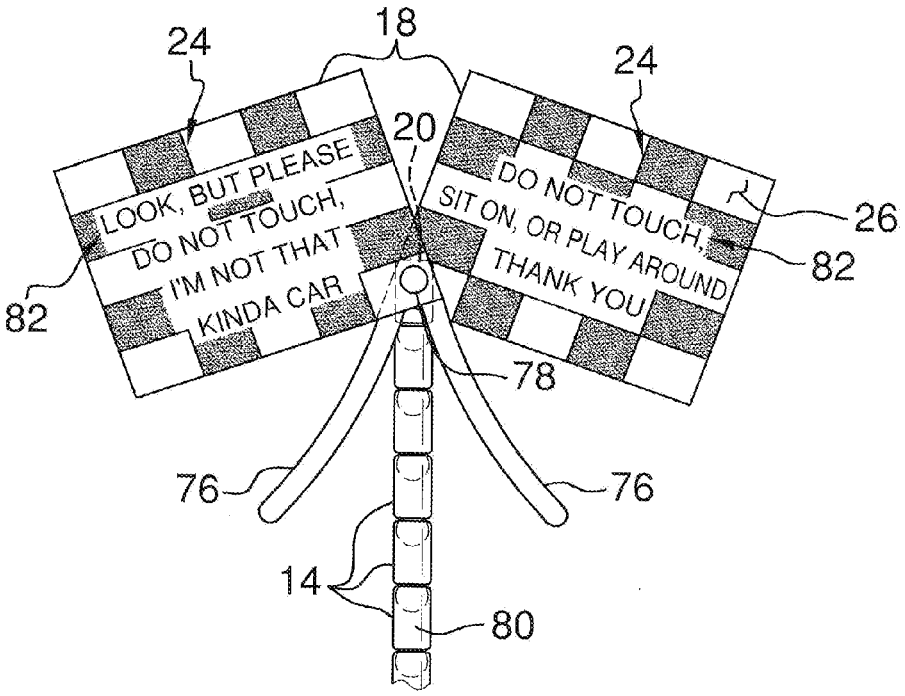
FIG. 2 is a front view of an embodiment of the disclosure.
Figure 3:
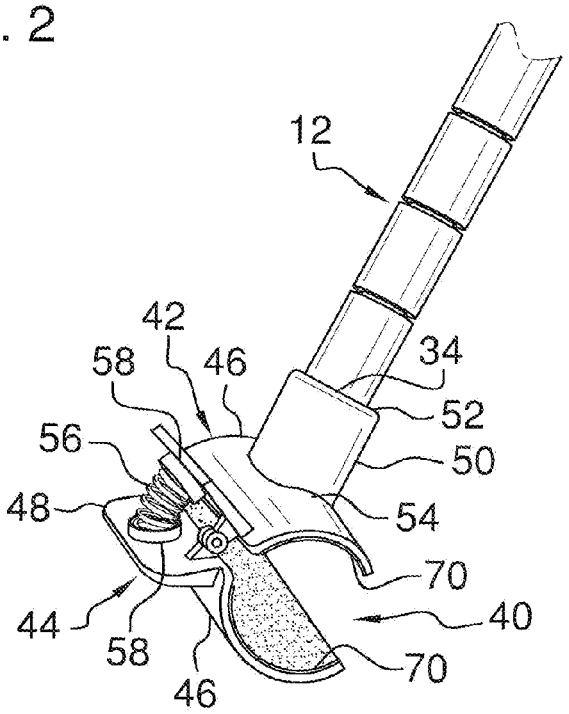
FIG. 3 is a detailed view showing a clamp of an embodiment of the disclosure.
Figure 4:
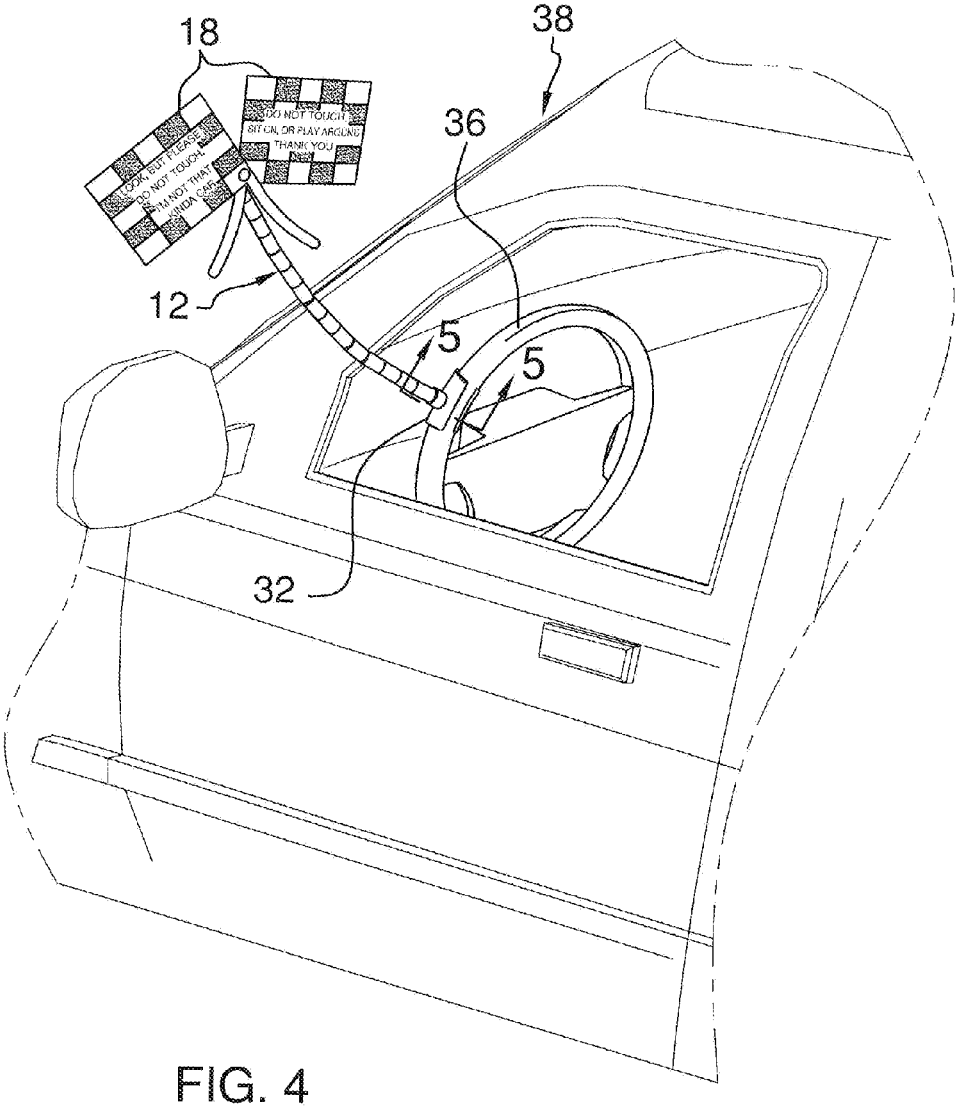
FIG. 4 is an in-use front view of an embodiment of the disclosure.
Figure 5:
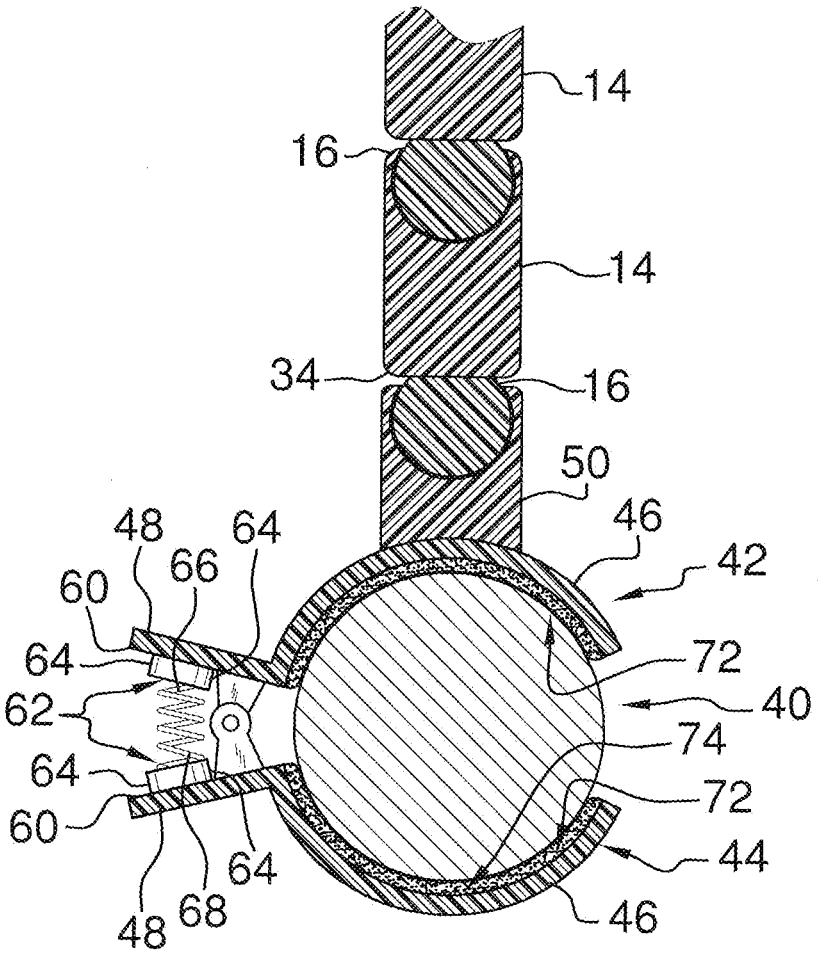
FIG. 5 is a cross-sectional view of an embodiment of the disclosure taken along line 5-5 of FIG. 4.

With reference now to the drawings, and in particular to FIGS. 1 through 5 thereof, a new sign holding apparatus embodying the principles and concepts of an embodiment of the disclosure and generally designated by the reference numeral 10 will be described.

As best illustrated in FIGS. 1 through 5, the mountable sign holding apparatus 10 generally comprises an elongated tube 12. The tube 12 may be flexible and have a plurality of adjacently positioned tubular sections 14. A ball joint 16 preferably couples each of the tubular sections 14 wherein the ball joints 16 permit the tubular sections 14 to pivot relative to each other. In this manner, the tube 12 may be bent as desired in order to be visible to pedestrians positioned near the tube 12. The tube 12 may have a length between approximately 60 centimeters and 70 centimeters.

At least one sign 18 is coupled to the tube 12. Preferably, two signs 18 are coupled to tube 12. The signs 18 extend outwardly from an upper end 20 of the tube 12. The signs 18 overlap at adjacently positioned corners 22. Each of the signs 18 may have a checkered design 24 for drawing attention of a viewer to the signs 18. Each of the signs 18 has a front surface 26, a back surface 28, and a perimeter wall 30 extending between an associated one of the front 26 and back 28 surfaces.

A coupler 32 is attached to a bottom end 34 of the tube 12 and is configured to frictionally engage a steering control 36 of a vehicle 38 and support each of the tube 12 and the signs 18 on the steering control 36. The coupler 32 thus provides an alternative to securing signs 18 to a window of the vehicle 38. The vehicle 38 may include an automobile, a boat, a bike, or the like. The tube 12 may be positioned such that the signs 18 extend from the steering control 36 out of the window of the vehicle 38. Alternatively, the tube 12 may be positioned so that the signs 18 are visible through the windshield or windows of the vehicle 38. The coupler 32 may be elongated and comprise a cylinder having a break 40 therein to receive the steering control 36. The coupler 32 preferably has a first clamping portion 42 hingedly coupled to a second clamping portion 44. Each of the first clamping portion 42 and the second clamping portion 44 has a main body 46 and a tab 48. The tabs 48 are positioned opposite the break 40. A connector 50 preferably couples the tube 12 to the coupler 32. An upper end 52 of the connector 50 is coupled to the bottom end 34 of the tube 12 preferably by one of the ball joints 16 so that the tube 12 can pivot relative to the connector 50. A lower end 54 of the connector 50 may be coupled to the main body 46 of the first clamping portion 42.

A biasing member 56 is coupled to and extends between the first clamping portion 42 and the second clamping portion 44 wherein the biasing member 56 biases the first clamping portion 42 away from the second clamping portion 44. The biasing member 56 may comprise a spring. A pair of rings 58 is coupled to the coupler 32. Each of the rings 58 is positioned on an inner surface 60 of an associated one of the tabs 48. Each of the rings 58 has a gap 62 extending between opposite ends 64 of the ring 58. A first end 66 and a second end 68 of the biasing member 56 extend into an associated one of the gaps 62.

A pair of pads 70 is preferably coupled to the coupler 32. Each pad 70 is positioned on an inner surface 72 of the main body 46 of the couplers 32. The pads 70 may be comprised of a resiliently compressible material 74 wherein the pads 70 are configured to prevent damage to the coupler 32 and the steering control 36 when the coupler 32 is attached to the steering control 36.

A pair of arcuate arms 76 extends downwardly from the signs 18. The arms 76 extend in opposite directions with respect to each other. A fastener 78 couples the signs 18 to the tube 12. The fastener 78 is coupled to the upper end 20 of the tube 12 and may be positioned on a front side 80 of the tube 12. Each of the arms 76 is pivotally coupled to the fastener 78 such that manipulation of the arms 76 pivots the signs 18 about the fastener 78.

Warning indicia 82 may be positioned on each of the signs 18. The warning indicia 82 displays a message directing viewers to refrain from touching the vehicle 38 when the signs 18 are attached to the vehicle 38. In this manner, the warning indicia 82 is designed to prevent against finger-printed and hand-printed surfaces on the vehicle 38. The warning indicia 82 is positioned on the front surface 26 of the signs 18 and is preferably centered on the signs 18.

In use, as stated above and shown in the Figures, the coupler 32 is attached to the steering control 36 of the vehicle 38 by manipulating the first 42 and second 44 clamping portions. The tube 12 is positioned to extend either outwardly of the window of the vehicle 38 or so that the tube 12 is visible through the windows or windshield of the vehicle 38. The arms 76 are manipulated to pivot the signs 18 to a selectable location relative to the tube 12. The warning indicia 82 directs viewers of the signs 18 to refrain from touching the vehicle 38 when the coupler 32 is attached to the steering control 36 of the vehicle 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A mountable sign holding apparatus comprising:

a vehicle including a steering control;

an elongated tube;

a sign coupled to and extending outwardly from an upper end of said tube, said sign having warning indicia thereon, said warning indicia displaying a message directing viewers to refrain from touching the vehicle when said signs are attached to the vehicle; and a coupler being attached to a bottom end of said tube, said coupler being frictionally engaged to said steering control and supporting each of said tube and said sign on the steering control;

wherein said steering control includes a steering wheel including a closed outer loop configured to be gripped by a person, said coupler frictionally engaging said closed outer loop.

2. The apparatus of claim 1, further comprising said tube being flexible.

3. The apparatus of claim 2, further comprising said tube having a plurality of adjacently positioned tubular sections.

4. The apparatus of claim 3, further comprising a ball joint coupling each of said tubular sections wherein said ball joints permit said tubular sections to pivot relative to each other.

5. The apparatus of claim 1, further comprising said sign being one of a pair of signs such that each of said signs extends outwardly from said upper end of said tube, each of said signs having said warning indicia thereon.

6. The apparatus of claim 5, further comprising said signs overlapping at adjacently positioned corners of each of said signs.

7. The apparatus of claim 5, further comprising each of said signs having a checkered design for drawing attention of a viewer to said signs.

8. The apparatus of claim 5, further comprising said coupler being elongated and comprising a cylinder having a break therein to receive the steering control.

9. The apparatus of claim 8, further comprising said coupler having a first clamping portion coupled to a second clamping portion, each of said first clamping portion and said second clamping portion having a main body and a tab, said tabs being positioned opposite said break.

10. The apparatus of claim 9, further comprising said first clamping portion being hingedly coupled to said second clamping portion.

11. The apparatus of claim 10, further comprising a biasing member coupled to and extending between said first clamping portion and said second clamping portion wherein said biasing member biases said first clamping portion away from said second clamping portion, said biasing member comprising a spring.

12. The apparatus of claim 11, further comprising a pair of rings coupled to said coupler, each of said rings being positioned on an inner surface of an associated one of said tabs, each of said rings having a gap extending between opposite ends of said ring, a first end and a second end of said biasing member extending into an associated one of said gaps.

13. The apparatus of claim 9, further comprising a connector coupling said tube to said coupler, an upper end of said connector being coupled to said bottom end of said tube, a lower end of said connector being coupled to said main body of said first clamping portion.

14. The apparatus of claim 9, further comprising a pair of pads coupled to said coupler, each pad being positioned on an inner surface of said main body of said couplers, said pads being comprised of a resiliently compressible material wherein said pads are configured to prevent damage to said coupler and the steering control when said coupler is attached to the steering control.

15. The apparatus of claim 5, further comprising:

a pair of arcuate arms extending downwardly from said signs, said arms extending in opposite directions with respect to each other; and a fastener coupling said signs to said tube, said fastener being coupled to said upper end of said tube, said fastener being positioned on a front side of said tube, each of said arms being pivotally coupled to said fastener such that manipulation of said arms pivots said signs about said fastener.

16. The apparatus of claim 5, further comprising:

each of said signs having a front surface, a back surface, and a perimeter wall extending between an associated one of said front and back surfaces; and said warning indicia being centered on said front surface of said signs.

17. A mountable sign holding apparatus comprising:

a vehicle including a steering control;

an elongated tube, said tube being flexible, said tube having a plurality of adjacently positioned tubular sections;

a ball joint coupling each of said tubular sections wherein said ball joints permit said tubular sections to pivot relative to each other;

a pair of signs coupled to said tube, said signs extending outwardly from an upper end of said tube, said signs overlapping at adjacently positioned corners of said signs, each of said signs having a checkered design for drawing attention of a viewer to said signs, each of said signs having a front surface, a back surface, and a perimeter wall extending between an associated one of said front and back surfaces;

a coupler being attached to a bottom end of said tube, said coupler frictionally engaging said steering control and supporting each of said tube and said signs on the steering control, said coupler being elongated and comprising a cylinder having a break therein to receive the steering control, said coupler having a first clamping portion hingedly coupled to a second clamping portion, each of said first clamping portion and said second clamping portion having a main body and a tab, said tabs being positioned opposite said break;

said steering control includes a steering wheel including a closed outer loop configured to be gripped by a person, said coupler frictionally engaging said closed outer loop;

a biasing member coupled to and extending between said first clamping portion and said second clamping portion wherein said biasing member biases said first clamping portion away from said second clamping portion, said biasing member comprising a spring;

a pair of rings coupled to said coupler, each of said rings being positioned on an inner surface of an associated one of said tabs, each of said rings having a gap extending between opposite ends of said ring, a first end and a second end of said biasing member extending into an associated one of said gaps;

a connector coupling said tube to said coupler, an upper end of said connector being coupled to said bottom end of said tube, a lower end of said connector being coupled to said main body of said first clamping portion;

a pair of pads coupled to said coupler, each pad being positioned on an inner surface of said main body of said couplers, Said pads being comprised of a resiliently compressible material wherein said pads are configured to prevent damage to said coupler and the steering control when said coupler is attached to the steering control;

a pair of arcuate arms extending downwardly from said signs, said arms extending in opposite directions with respect to each other;

a fastener coupling said signs to said tube, said fastener being coupled to said upper end of said tube, said fastener being positioned on a front side of said tube, each of said arms being pivotally coupled to said fastener such that manipulation of said arms pivots said signs about said fastener; and warning indicia being positioned on each of said signs, said warning indicia displaying a message directing viewers to refrain from touching the vehicle when said signs are attached to the vehicle, said warning indicia being positioned on said front surface of said signs, said warning indicia being centered on said signs.

* * * * *